United States Patent [19]

Bowden et al.

[11] Patent Number: 4,899,925

[45] Date of Patent: Feb. 13, 1990

[54] CROWNED MEAT TRAY

[75] Inventors: Thomas A. Bowden, Tinley Park; Brian L. Wilt, Frankfort, both of Ill.

[73] Assignee: Mobil Oil Corporation, New York, N.Y.

[21] Appl. No.: 240,306

[22] Filed: Sep. 6, 1988

Related U.S. Application Data

[63] Continuation-in-part of Ser. No. 175,076, Mar. 30, 1988, abandoned.

[51] Int. Cl.[4] ..... B65D 1/42

[52] U.S. Cl. ..... 229/2.5 R; DIG. 9/425; DIG. 9/432

[58] Field of Search ..... 229/2.5 R; 206/45.33; 426/124, 129, 130; DIG. 9/425–429, 432

[56] References Cited

U.S. PATENT DOCUMENTS

| | | | |
|---|---|---|---|
| D. 180,699 | 7/1957 | Raymond | DIG. 9 425 |
| D. 182,040 | 2/1958 | Raymond | DIG. 9 425 |
| D. 232,612 | 9/1974 | Christian et al. | DIG. 9 425 |
| D. 294,466 | 3/1988 | Culver | DIG. 9 425 |
| 2,029,662 | 2/1936 | Kernen | 229/2.5 R |
| 2,920,805 | 1/1960 | Reifers | 229/2.5 R |
| 3,489,270 | 1/1970 | Bixler et al. | 426/124 |
| 3,720,365 | 3/1973 | Unger | 229/2.5 R |
| 3,926,363 | 12/1975 | Catron | 229/2.5 R |
| 3,934,723 | 1/1976 | Walker | 229/2.5 R |
| 4,058,247 | 11/1977 | Florian | 229/2.5 R |
| 4,349,146 | 9/1982 | Holden | 229/2.5 R |
| 4,442,969 | 4/1984 | Holden | 229/2.5 R |
| 4,573,632 | 3/1986 | Scheeren | 229/2.5 R |
| 4,623,088 | 11/1986 | Holden | 229/2.5 R |

*Primary Examiner*—Gary Elkins

*Attorney, Agent, or Firm*—Alexander J. McKillop; Charles J. Speciale; Michael J. Mlotkowski

[57] ABSTRACT

A crowned packaging tray and, more particularly a high-strength, molded packaging tray for use in packaging meats, fish, poultry and other comestibles, and non-food commodities, which is adapted to be utilized in conjunction with a transparent overwrap film. The packaging tray is provided with a novel tray bottom wall incorporating a high-crowned center portion encompassed by a peripheral bottom rim providing a support surface for the tray. This raised high-crowned portion will provide for an increase in the strength of the tray, while holding up the packaged product for an enhanced aesthetic appearance thereof.

12 Claims, 2 Drawing Sheets

CROWNED MEAT TRAY

CROSS-REFERENCE TO RELATED PATENT APPLICATIONS

This application is a continuation-in-part patent application of Ser. No. 175,076; filed Mar. 30, 1988, abandoned.

BACKGROUND OF THE INVENTION

1. Field of the Invention

The present invention relates to a packaging tray and, more particularly, to a high-strength, reinforced molded plastic packaging tray for specific, although not exclusive, use in the packaging of meats, fish, poultry, other kinds of comestibles, and al so non-food products, which is adapted to be utilized in conjunction with a transparent overwrap film.

The inventive packaging tray is provided with a bending-resistant peripheral lip structure which will aid in preventing the collapse or fracture of the tray sidewalls in view of pressures exerted on the tray bottom by the weight of the contents and by the overwrap film when applied to the tray either manually or in an automatic tray overwrap machine. Moreover, pursuant to the invention, the packaging tray is provided with a unique upwardly arcing crowned tray bottom wall structure providing for an extensively raised central bottom portion such that the tray normally rests on a flat surface extending about the periphery of the tray bottom proximate the juncture between the tray bottom wall and the side walls of the tray, thereby causing loads in the tray to increase the pressure per unit of area over the overwrap film seal areas of the tray bottom.

In many modern food retailing operations, such as in supermarkets, meat and produce markets and the like, there are customarily employed many types and sizes of food trays which are usually molded from wood or paper pulp or from various polymeric plastic materials, for instance, foamed plastic, for the display and packaging of meats, fish, poultry and other produce or comestibles.

In addition thereto, such trays may be frequently utilized in connection for the packaging and display of non-food products or commodities; for instance, items which may be sold in hardware stores, such as bolts and nuts, wrenches, screwdrivers and the like, amongst numerous others. Generally, these trays are relatively shallow rectangular flat-bottomed trays having outwardly inclined upstanding peripheral sidewalls, into which the commodities are placed, and thereafter a transparent heat-sealable material, such as a heat-shrinkable or stretchable plastic film, is tightly wrapped and sealed about the tray bottom so as to resultingly produce an attractive retail package. This type of package is extremely neat and aesthetically appealing to retail consumers, and concurrently forms a protective arrangement for the commodity contained therein while allowing prospective customers to view its contents, so as to greatly assist in the sale of the commodities.

To a considerable extent, the packaging of the commodities and subsequent sealing of the commodity-containing tray with the transparent overwrap film has usually been manually carried out by generally unskilled or semi-skilled labor. Although the packages obtained in this manner are, as a rule, satisfactory in their appearance and in the quality of sealing of the commodities, the procedure has been slow and cumbersome and not at all adapted to meeting high-volume production demands.

In recent decades, and at an ever increasing percentage of the total tray wrapping market, there have been developed automatic tray overwrap machines which, at high rates of speed, will wrap and seal a tray containing a commodity, such as meat, fish, poultry, vegetables, or the like comestibles, or non-food products, with a transparent overwrap film constituted of a suitable material of the kind mentioned hereinabove. Although the automatic overwrap machines to a large extent fulfill the demand for supplying wrapped trays of the type in question to a highly satisfactory degree, certain problems have been encountered in their use. Thus, the automatic overwrap machines, when positioning or contacting the trays for contact with the overwrap film, and during the sealing of the film to the trays, are prone to impart relatively high forces or bending loads to the sidewalls of the trays, thereby generating extremely high localized stresses which tend to frequently cause the side or end walls of the tray to buckle and/or fracture. This buckling may be the result of the inwardly directed forces exerted on the sidewalls of the tray due to impact by the machines and/or an outward bending force imparted to the sidewalls by the overwrap film which is being applied onto the commodity-containing trays.

Further basic causes of tray failure when the trays are overwrapped with transparent film in automatic machines may be ascribed to poor tray design for the intended applications thereof; in essence, inadequate sidewall and tray bottom strength; incorrect design criteria in the interrelationship between the tray bottom and the upright wall structures; design of automatic equipment and the like, amongst other factors.

In essence, the failures of packaging trays while being provided with an overwrap film enclosing the comestibles on the tray in automatic tray overwrap equipment be primarily ascribed to one or more of the following:

1. Bending or breaking at the sidewall to tray bottom transitional radius due to a concentration of inwardly or outwardly directed bending moment stresses at this point in the tray.

2. Distortion, folding or breaking of the trim lip extending about the tray resulting from the large surface film contact area of the trim flange on the tray and the high coefficient of friction between the foamed plastic tray surface with the overwrap film surface.

3. the strength and resistance to buckling of the tray bottom wall resulting from the weight of the commodity in the tray and the forces exerted thereon by the overwrap film material.

4. Bowing and resultant buckling of the trays when subjected to the wrapping forces in the equipment, and the related package instability imparted thereto by the remainder of the automated weighing/pricing/labeling equipment.

Another significant problem which is encountered resides in providing the formation of an adequate seal between the surface of the tray bottom and the overwrap plastic film material as the product-containing packaging tray is conveyed through a sealing apparatus, such as a heat sealer.

Occasionally, packaging trays are encountered which, due to various manufacturing or product-receiving reasons or the like, may possess a tray bottom structure with an outward or convex bow rather than a flat surface. Consequently, the normally flat surface area of the tray bottom and the covering overwrap film material which is adapted to be contacted by the sealing apparatus about the perimeter of the tray bottom which is now slightly raised, is reduced by a considerable extent, and as a result sealing procedure is adversely affected so as to produce a relatively poor sealing contact between the tray bottom and the overwrap film material.

2. Discussion of the Prior Art

To some degree, the prior art has taken cognizance of the problems which are commonly encountered in the wrapping of trays with an overwrap film of the type described.

Holden U.S. Pat. No. 4,349,146, assigned to the common assignee of the present application, discloses a molded packaging tray for the packaging of comestibles, which possesses a reinforced peripheral lip structure extending about the upper ends of the tray sidewalls which will aid in preventing the collapse and fracture of the sidewalls caused by pressures exerted thereon by an overwrap film when applied thereto by an automatic tray overwrap machine.

Holden U.S. Pat. No. 4,442,969, also assigned to the common assignee of the present application, pertains to a novel reinforced molded packaging tray which, in addition to a strengthened peripheral lip structure encompassing the tray sidewalls, provides for the incorporation of integral stiffening rib structure in the bottom wall of the packaging tray. This will impart further strengthening against buckling to the packaging tray, which is of particular significance to larger-sized trays, commonly referred to as family pack trays.

Although the foregoing Holden U.S. Pat. Nos. 4,349,146 and 4,442,969 to a significant extent meet the needs of the industry with regard to the rapid and automated packaging of comestibles, such as meats, fish, poultry and the like, there is a need for the provision of packaging trays of this type which can satisfy the more stringent demands as to high strength which, for example, are frequently placed on the larger sized so-called family pack and other sizes of trays which contain larger amounts of and resultingly heavier quantities of the commodities. This is accomplished through the provision of a molded packaging tray, as described in Holden U.S. Pat. No. 4, 623,088, also assigned to the common assignee of the present application which is adapted for use with an overwrap film in which the peripheral lip structure on the sidewalls of the tray is configured to minimize the surface contact with the overwrap film irrespective as to whether the commodity contained in the tray exceeds or is less than the overall interior height of the packaging tray. Pursuant to various embodiments of the packaging tray described therein, the tray also incorporates stiffening rib structure integrally formed in the basically flat bottom wall structure of the tray so as to still further enhance the overall strength of the packaging tray. Additionally, this patent discloses a packaging tray in which the central portion of the tray bottom is raised to some slight extent so as to provide for an increase in the pressure acting over the peripheral overwrap seal areas on the tray bottom.

The inventive meat or packaging tray improves upon the properties of the above-mentioned prior art trays through the provision of a crowned tray bottom, in which the crowned bottom portion, in the unloaded or empty unweighted state of the tray, is raised to a height which is at least a substantial proportion of the total overall height of the tray, or in which the crowned portion may even extend the full height thereof, and wherein a preferably thickened side radius joins the periphery of the tray bottom to form a transition to the sidewalls of the tray so as to considerably increase the resistance of the tray to buckling and deformation loads and stresses.

SUMMARY OF THE INVENTION

Accordingly, it is an object of the present invention to provide a molded packaging or meat tray of the type described hereinabove, preferably constituted of a polymeric material, which includes reinforcing lip structure extending about the upper ends of the sidewalls of the tray, and a substantially highly crowned tray bottom wall configuration which is adapted to resist forces and stresses tending to cause failure of the tray.

A more specific object of the invention resides in the provision of a reinforced molded meat packaging tray incorporating a high crowned tray bottom structure and a thickened radius portion connecting the periphery of the tray bottom with the sidewalls thereof and tending to enhance resistance to bending and deformation stresses, and which moreover, will protect the packaging tray from fracturing or collapsing when loaded with a commodity and then wrapped with a transparent overwrap film in an automatic overwrap machine.

A still more specific object of the present invention resides in the provision of a tray bottom structure incorporating a raised or substantially high crowned central portion so as to in cooperation with the thickened side radius structure, produce a high-strength packaging tray which is readily employable as a tray for meats, poultry, fish and other comestibles, as well as non-food commodities, imparts an aesthetically pleasing appearance to the contents of the tray, and which facilitates an improved sealing contact between the bottom of the packaging tray, the overwrap film material and the heated seal area in the wrapping equipment.

Pursuant to the invention, the meat packaging tray includes a tray bottom having a raised or crowned central portion of substantially height in the unloaded state of the tray, thereby forming a flat peripheral rim extending into a thickened radius joining the sidewalls of the tray, on which the packaging tray rests on a flat surface. This will cause loads in the tray to increase the pressure per unit of area over the overwrap film seal areas of the tray bottom and to provide an improved seal between the tray bottom and the overwrap film material during sealing thereof.

In accordance with a preferred embodiment of the inventive packaging tray, the raised or crowned bottom portion represents a major portion of the total tray bottom area, and in the unloaded or unweighted state of the tray, rises to more than one-half of the overall height of the tray, such as to "hold up" the product contained therein towards and into possible surface contact with the overlying transparent overwrap film, thereby enhancing the aesthetic appeal of the displayed packaged product to a potential retail customer.

In accordance with another aspect of the invention, the thickness of the tray walls and bottom structure may be conceivably reduced in certain regions in comparison with presently employed packaging trays in order to substantially lower demands on material in forming the tray, thereby resulting in appreciable reductions in material and production costs.

DESCRIPTION OF THE DRAWINGS

Reference may now be had to the following detailed description of a preferred embodiment of the molded crowned meat or packaging tray of the invention, taken in conjunction with the accompanying drawings; in which.

DETAILED DESCRIPTION OF THE DRAWINGS

Figure 1:
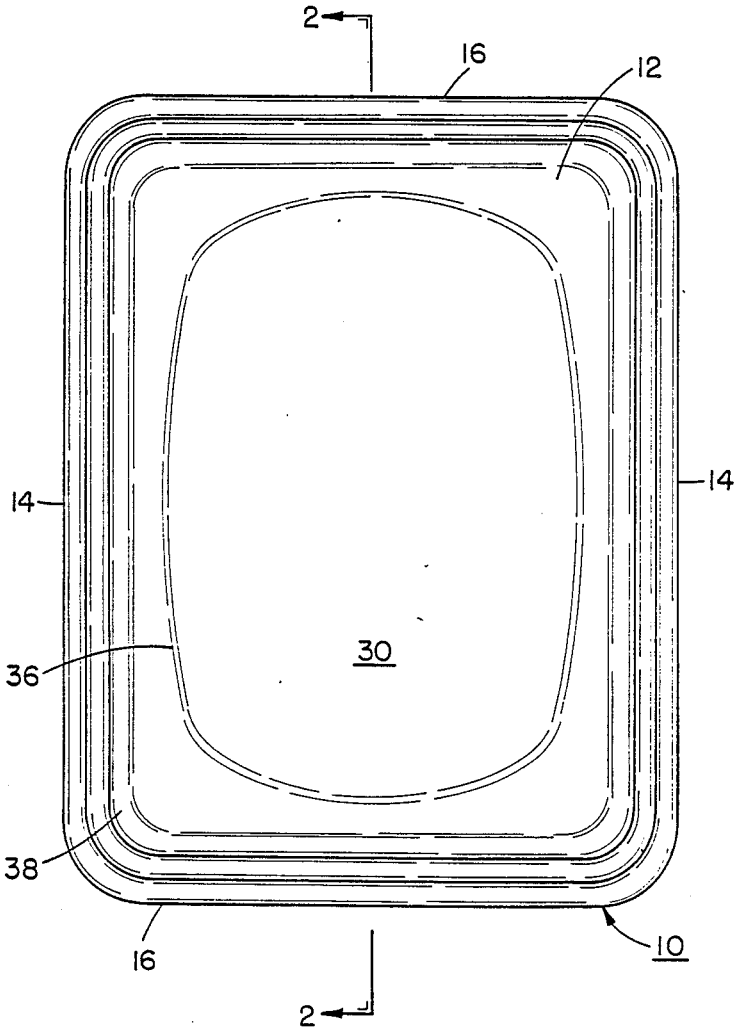
FIG. 1 illustrates a top plan view of a packaging tray constructed pursuant to the invention.

As shown in the drawings, the inventive packaging tray 10 includes a bottom portion 12, and upwardly and outwardly inclined sidewalls 14 and 16. The tray is formed of a suitable molded pulp or foamed plastic material, as is well known in the packaging tray art. In the present instance, by way of illustrative example only, the packaging tray 10 may be of the large-sized, so-called family pack tray genre, having rectangular, overall nominal trim dimensions of 10"×14", but may also nominally be 8"×15", 8"×16", 8"×18", 12"×16", 9"×12", or alternatively, of the widely-commercialized "S" class of trays (shallow trays), or any other combination of overall tray size, and an overall commensurate tray height of up to about 0.8 to 1.0 in., and upon occasion and need even higher, depending upon the tray size and intended packaging purpose.

Quite apparently, these dimensions are only illustrative of commonly employed tray sizes, and numerous other tray sizes and heights with various internal tray depths readily lend themselves to the present invention.

Figure 3:
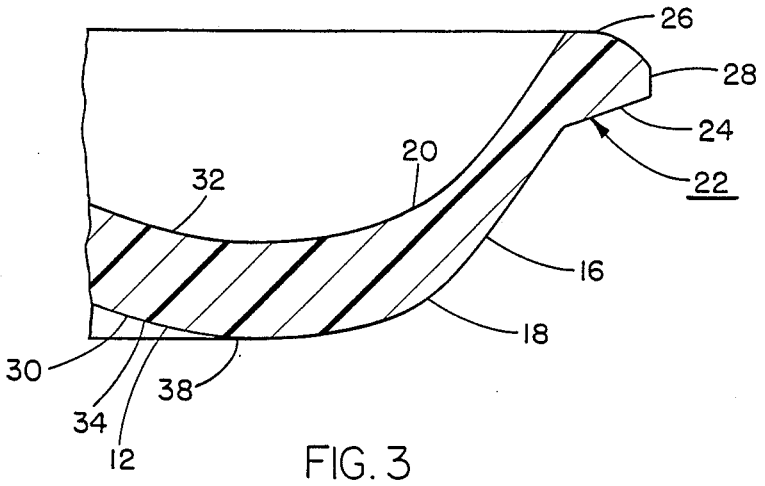
FIG. 3 is an enlarged scale sectional view of the encircled portion A in FIG. 2, illustrative of the tray lip structure.

Having particular reference to the enlarged scale FIG. 3 of the drawings, the end walls 16, as well as sidewalls 14, all of which are hereinafter referred to as sidewalls for purposes of simplicity, curve at their lower ends into the tray bottom structure 12 with large transitional radii, wherein the inner transitional radius 20 is larger than or preferably equal to the outer transitional radius 18 so as to, if desired, enlarge the material cross-sectional thickness in this transitional area to alleviate the formation of any localized stress concentrations in the regions of transition between the bottom of the tray and the sidewalls. Moreover, the thickness of the tray wall defined by the transitional radii, which may be the full-blown thickness of the plastic material, affords a balanced stress distribution adapted to resist side-to-side loads acting on the crowned tray which is substantially greater than that for a flat or only slightly-crowned tray.

Preferably, although not necessarily, the thicknesses of the sidewalls 14, 16 may be constant along their height between the tray lip structure and the transitional radii 18, 20, although it is also possible to contemplate sidewalls possessing a varying thickness; i.e. a reducing thickness towards the upper end thereof Integrally formed at the upper end of each of the sidewalls 14, 16 is a radially outwardly extending peripheral lip structure 22, with the lip structure being shown as having a generally flat upwardly and outwardly sloping bottom surface 24 and a convexly curved upper surface 26 which connects with the radially outer end of bottom surface by means of a vertical planar surface 28.

However, the illustrated configuration of above-described tray lip structure 22 is considered to be merely representative of one embodiment of the inventive reinforced packaging tray, and it is to be understood by one skilled in the art that any suitable lip structure configuration may be readily employed in conjunction with the inventive tray bottom structure as more closely defined hereinbelow. Thus, if desired, the tray lip structure may have a configuration as described in the above-mentioned Holden U.S. Pat. No. 4,623,088, the disclosure of which is incorporated herein by reference.

Figure 2:
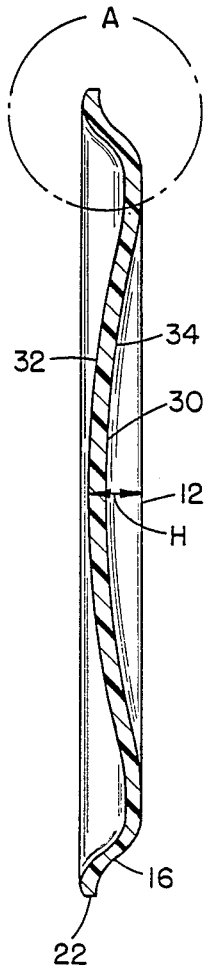
FIG. 2 is a sectional view taken along line 2—2 in FIG. 1.
Figure 4:
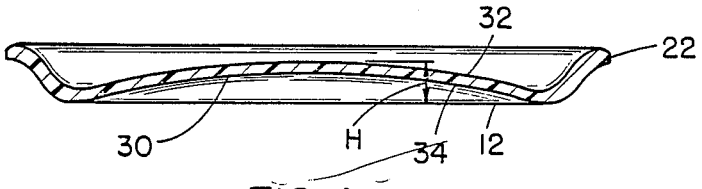
FIG. 4 is a sectional view similar to FIG. 2 but taken in the transverse direction of the packaging tray.
Figure 5:
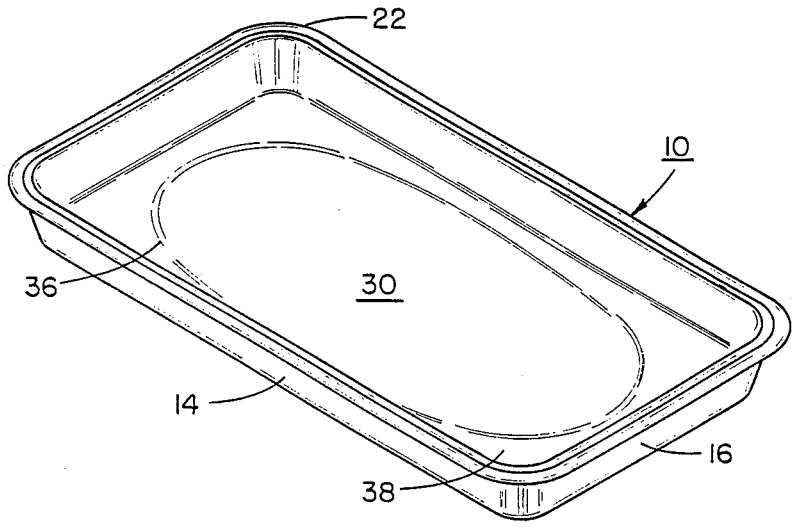
FIG. 5 is a perspective view of the inventive, packaging tray.

The inventive bottom wall portion 12 of the meat packaging tray 10 includes an extensively raised or crowned central portion 30 which, as is clearly illustrated in FIG. 1 may be of a generally oval, ellipsoid, or circular configuration in plan view, extending over the major portion of the bottom surface In cross-section, as is evident from FIGS. 2 and 4, the crowned central portion 30 is arcuately upwardly curved from the peripheral edges thereof so as to attain a maximum rise or height H of the upper surface of the tray bottom wall structure 12 above the bottom plane of the tray and at the center of the tray. The curvilinear upper and lower surfaces 32 and 34 of the crowned central portion 30 generally commence their upward incline from a substantially flat peripheral bottom rim section 36 which encompasses the central portion 30, and whose flat lower surface 38 represents the area of the meat packaging tray 10 on which the latter is supported.

In essence, pursuant to the invention, the maximum height H of the crowned central portion 30, in the unloaded or unweighted condition of the tray, extends from a minimum of about 40 to 50% of the overall internal height of the meat packaging tray 10 up to a maximum height at which the highest point of the upper curvilinear surface 32 of the crowned central portion 30 is substantially at an elevation plane which is coextensive with the upper surface 26 of the peripheral lip structure 22.

This intense curvature of the crowned central portion 30 provides for a considerable increase in the strength of the tray, and particularly the bottom wall structure thereof, up to a 60% increase, in resisting bending and buckling loads applied from externally to the tray and from the commodity contained therein. Additionally, the increase in the strength of the tray bottom structure 12 produced by the highly-crowned configuration thereof allows for a significant reduction in the weight of this tray structure, enabling a considerable savings in material, thereby rendering the manufacture of the tray less expensive and resulting in extensive costs savings An additional benefit obtained in the merchandising of the inventive crowned meat packaging tray is obtained through an improved aesthetic appearance of the package and the product, other type of comestible or non-food commodity contained therein. This is caused by the uplifting of the package product for display, causing that the transparent overwrap to be stretched more tightly over the exposed surface of the product so as to render the latter highly attractive to a consumer.

In addition to the foregoing, the increase in the fracture point or failure limit and resistance of deformation under a side-to-side load which is imparted to the packaging overwrap tray will prevent the tray from failing in a display case as a result of forces applied by the overwrap stretch or shrink film material tightening up, and will provide an improved resistance to deformation of the tray, facilitating the obtention of a superior package appearance; in effect, a tighter wrap, "fuller" appearance of the packaged product; for instance, meats or the like, and a generally better appearance of the overall tray and its contents. In addition, the superior strength obtained by the high-crowned packaging tray allows for a more defect-free machinability in automatic packaging machines.

While the tray of the present invention may be molded of conventional wood or paper pulp stock which may be formed or preformed from a water slurry, it will be understood that the construction provided is particularly suitable to the manufacture, preferably by molding, of trays from other materials, such as various kinds of polymeric materials, particularly foam plastic or even solid plastic. Thus, the tray of the present invention may be formed of other, equivalent materials, with the structural advantages of the tray being derived from its geometry. Among other suitable tray materials there may be mentioned conventional polystyrene foam, structural cellular polystyrene foam, porous polyolefin material, open cell polystyrene foam, or biodegradable polystyrene foam.

While there has been shown and described what is considered to be a preferred embodiment of the invention, it will of course be understood that various modifications and changes in form or detail could readily be made without departing from the spirit of the invention. It is therefore intended that the invention be not limited to the exact form and detail herein shown and described, nor to anything less than the whole of the invention herein disclosed as hereinafter claimed.

What is claimed is:

1. In a molded packaging tray for the packaging of meat, fish, poultry, comestibles or non-food commodities for use with a transparent overwrap film extending thereabout, said tray comprising upwardly and outwardly inclined side walls forming sides for said tray; bottom wall means for supporting said meat, fish, poultry, comestibles or commodities including a flat peripheral bottom wall portion; and a curvilinear wall portion extending between and joining said bottom wall and lower ends of said sidewalls so as to provide a smoothly contoured transitional surfaces therebetween of a thickness which is at least equal to the thickness of the adjoining bottom wall and sidewalls, the improvement wherein:

(a) said inclined sidewalls have a radially outwardly extending lip portion extending about said side walls proximate the upper ends thereof; and (b) said bottom wall portion of said tray including a high-crowned central portion of a generally ellipsoid, oval or circular configuration having continually upwardly curving walls, the highest point of said upwardly curving walls being at the center of said tray bottom, and crowned central portion of said tray bottom having an elevated height above the tray, bottom plane of at least 40 to 50% the maximum internal depth of said tray for the raised support of a product in said tray encompassed by a peripheral tray bottom surface forming a support surface for said packaging tray.

2. A molded tray as claimed in claim 1, wherein said bottom and sidewalls define a generally rectangular tray configuration.

3. A molded tray as claimed in claim 1, wherein said highest point on the crowned central portion of said tray bottom is substantially coplanar with an upper plane of said tray lip portion.

4. A molded tray as claimed in claim 1, wherein said tray sidewalls have a substantially constant thickness between the tray bottom and the lip portion.

5. A molded tray as claimed in claim 1, wherein the thickness at least at the middle of the high-crowned central portion of the tray bottom is less than the thickness of the peripheral bottom wall portion.

6. A molded tray as claimed in claim 1, wherein said transitional surface between said sidewalls and said bottom wall is of a thickness greater than the thickness of said walls.

7. A molded tray as claimed in claim 1, wherein said tray is constituted of a polymeric material.

8. A molded tray as claimed in claim 7, wherein said polymeric material comprises conventional polystyrene foam.

9. A molded tray as claimed in claim 7, wherein said polymeric material comprises structural cellular polystyrene foam.

10. A molded tray as claimed in claim 7, wherein said polymeric material comprises porous polystyrene foam.

11. A molded tray as claimed in claim 7, wherein said polymeric material comprises biodegradable polystyrene foam.

12. A molded tray as claimed in claim 7, wherein said polymeric material comprises porous polyolefin.

* * * * *

UNITED STATES PATENT AND TRADEMARK OFFICE

CERTIFICATE OF CORRECTION

PATENT NO. : 4,899,925

DATED : February 13, 1990

INVENTOR(S) : Thomas A. Bowden and Brian L. Wilt

It is certified that error appears in the above-identified patent and that said Letters Patent is hereby corrected as shown below:

| | |
|---|---|
| Col. 2, Line 50 | change "the" to -- Inadequate -- |
| Col. 5, Line 68 | add -- . -- after thereof |

Signed and Sealed this

Sixteenth Day of July, 1991

*Attest:*

HARRY F. MANBECK, JR.

*Attesting Officer*

*Commissioner of Patents and Trademarks*